US005340350A

United States Patent [19]

Fink et al.

[11] Patent Number: 5,340,350

[45] Date of Patent: Aug. 23, 1994

[54] MULTI-POSITIONAL INFLATABLE AUTO DECOY

[75] Inventors: Steven R. Fink; Floyd J. Herman, both of Landsdale Township, Montgomery County, Pa.

[73] Assignee: Sterman Enterprises, Inc., Landsdale, Pa.

[21] Appl. No.: 57,681

[22] Filed: May 4, 1993

[51] Int. Cl.[5] ..... A63H 3/06

[52] U.S. Cl. ..... 446/226; 446/374; 40/538

[58] Field of Search ..... 446/226, 220, 223, 268, 446/374, 370, 373, 390; 40/538, 439, 212, 214

[56] References Cited

U.S. PATENT DOCUMENTS

| | | | |
|---|---|---|---|
| 1,413,978 | 5/1922 | Franklin | 446/226 X |
| 1,697,459 | 1/1929 | Dorogi et al. . | |
| 1,714,558 | 5/1929 | Hauff | 446/226 |
| 2,170,539 | 8/1939 | Schoberg | 446/226 |
| 2,838,872 | 6/1958 | Beck | 446/226 |
| 2,916,849 | 12/1959 | Lemelson | 446/226 |
| 3,789,547 | 2/1974 | Chemarin | 446/390 X |
| 3,801,403 | 4/1974 | Lucek | 446/226 X |
| 4,277,910 | 7/1981 | Kramer | 446/390 X |
| 5,125,177 | 6/1992 | Colting | 446/226 X |

FOREIGN PATENT DOCUMENTS

| | | | |
|---|---|---|---|
| 1150624 | 1/1958 | France | 446/226 |
| 334352 | 9/1930 | United Kingdom | 446/226 |

*Primary Examiner*—Mickey Yu

*Attorney, Agent, or Firm*—Kenneth P. Glynn; Diane L. Ferrone

[57] ABSTRACT

The present invention teaches an inflatable body representative of at least the upper portion of a human form including a plastic inflatable exoskeleton with and inner side and an outer side molded to represent a torso, a head and appendages. Additionally, inserting means are located on either the inside or the outside of the plastic exoskeleton and are capable of receiving elongated inserts. These elongated inserts may be flexible wire, wooden dowels, plastic rods or any other suitable material. In a preferred embodiment, fasteners (preferably Velcro®) are attached to the outside of the plastic exoskeleton in the torso region and the appendage regions to hold the appendages in any number of desired positions. In another preferred embodiment, the appendages may include a hand equipped with fasteners which allow that hand to grasp and hold an object.

19 Claims, 4 Drawing Sheets

MULTI-POSITIONAL INFLATABLE AUTO DECOY

BACKGROUND OF THE INVENTION

1. Field of the Invention

The present invention relates to inflatable articles and more particularly to an inflatable human form with the ability to hold various poses which give a life-like appearance so the invention may serve as a decoy in a passenger seat of an automobile.

2. Information Disclosure Statement

Inflatable devices representing the human form are frequently used for a variety of purposes, including decoys. However, these inflatable devices are typically contoured to the desired human shape without the ability to change and hold various limb and extremity positions.

U.S. Pat. No. 1,413,978 issued to H. W. Franklin teaches inflatable india rubber toys made from sheets of rubber compound cemented together to represent various figures which are sturdy and color safe even if the toy is used in the bath. The limbs and extremities are not capable of changing position and holding that new position.

U.S. Pat. No. 1,714,558 teaches a method of making an inflatable toy so that it may be provided with, for example, a head and may also be supported by legs which are secured under the toy. However, any limbs and/or extremities are not capable of changing and holding various positions.

U.S. Pat. No. 1,697,459 teaches a method of making shaped, inflatable objects without the use of molds but is not directed toward an inflatable form which is capable of changing position and holding that position.

U.S. Pat. No. 2,170,539 teaches a toy balloon which can be inflated with sufficient internal pressure to give the device a substantial amount of rigidity and at the same time insure the retaining of its desired shape without bulging or distortion in certain areas. Once the desired shape is achieved through sufficient inflation, changeable positions of the shape are not possible or even desirable in this invention.

U.S. Pat. No. 3,801,403 teaches a method of making inflatable shaped articles having a fibrous skeletal component. This fibrous skeletal component is not, however, utilized to facilitate any change in position of the inflatable article. Quite the opposite, it is used to avoid bulging and distortion by limiting the outer wall expansion of a given article to a particular pre-determined position so the desired shape is maintained.

U.S. Pat. No. 5,125,177 to Hakan Holting teaches a multi-piece inflatable device with a base portion and a top portion releasably attached to the base so that the base portion can be used with variously shaped top portions. Again, the inflated device in any of its various combinations of forms is not capable of changing and holding various positions.

SUMMARY OF THE INVENTION

The present invention is intended to function as a deterrent to car jackets and other criminals who are more likely to strike an intended victim in an automobile if it is apparent that the driver is alone. The invention is a multi-positional inflatable decoy designed to give the appearance of a passenger. Elongated inserts and/or fasteners serve to enable the user to place and hold the decoy in various positions. It is therefore capable of assuming a more lifelike pose than prior art inflatable human forms. A user places the decoy in a position easily visible through the front and side windows. Once in place, the driver fastens the decoy in place with a seat belt. If desired, more than one decoy may be employed.

BRIEF DESCRIPTION OF THE DRAWINGS

The present invention is more fully understood when the specification herein is taken in conjunction with the drawings appended hereto wherein.

DETAILED DESCRIPTION OF THE INVENTION

Recently, the large number of car-jacking crimes reported as well as other forms of criminal activity in which the occupant of a car is assaulted and/or robbed has caused great concern among potential victims. Police departments throughout the country have issued warnings and helpful hints to avoid becoming a victim. These include such things as keeping the car locked whether you are in it or not, avoiding the use of the lane nearest the curb, being alert at stop signs and traffic lights, etc. It is even advised that children always be kept in the front seat so that a driver may more easily grab a child and pull it to safety in the event of an attack, but also to prevent a car jacket from inadvertently choosing a car carrying a child and/or inadvertently driving off in the stolen vehicle with a child in the back seat. There is an overall understanding and it is obvious that a lone driver is a more likely target than a driver accompanied by one or more passengers.

The present invention is directed to an inflatable multi-positional auto decoy designed to give the appearance of a passenger in an automobile. It is capable of being dressed with actual human clothing, if desired. Unlike prior art inflatable human forms, the present invention enables a user to position the decoy in various desired poses and hold the form in a desired position in order to give the decoy a more life-like appearance. For instance, the decoy could be positioned to hold a coffee cup in one hand.

Since the decoy is more than likely to be used at night when visibility is limited and the odds of an attack are much higher than during the day, the decoy may only represent the upper portion of the human body. Legs and feet and even hands are optional although hands are preferred. Once the decoy is placed in a desired position in the car, it is buckled into place with the car's seat belt.

Figure 1:
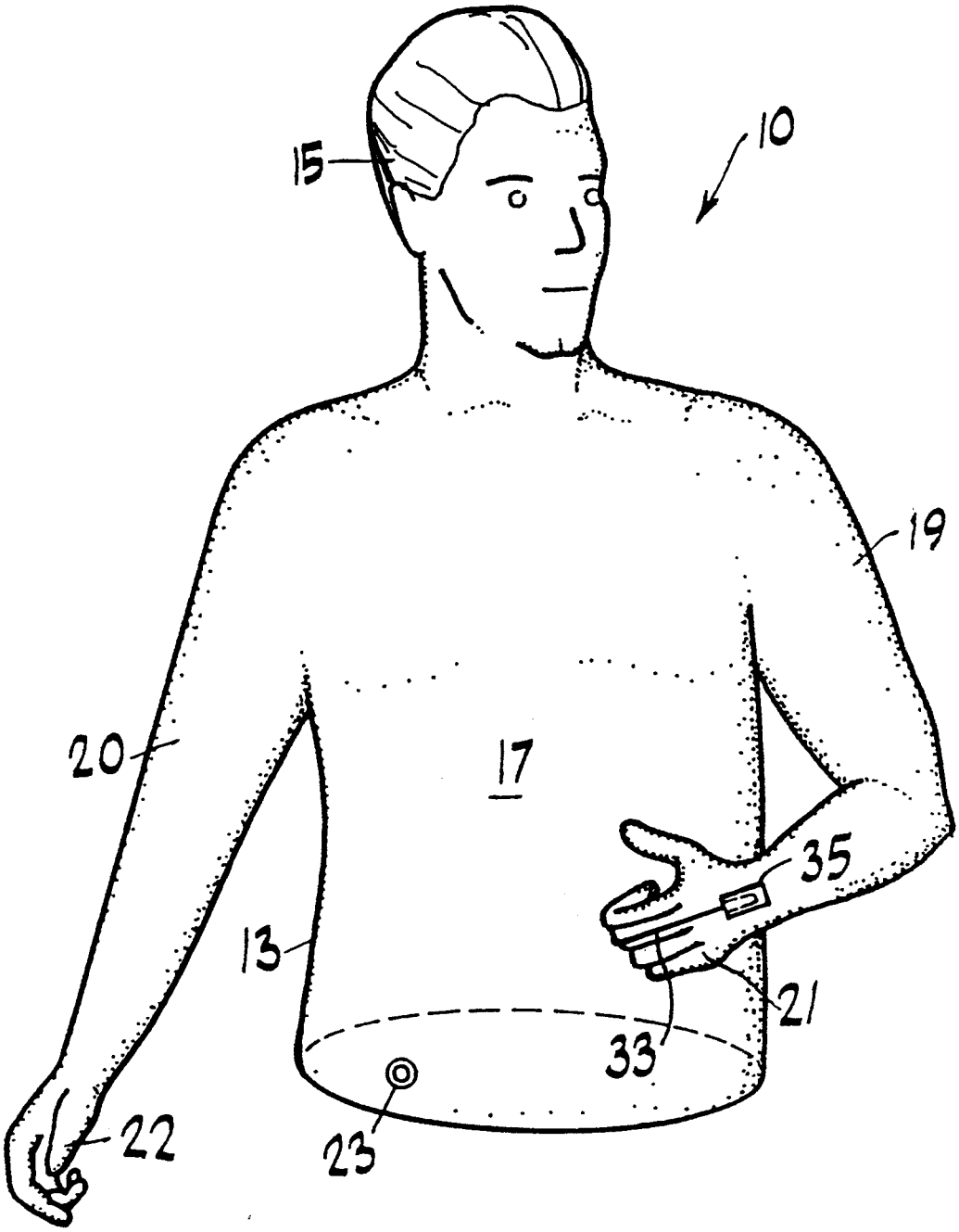
FIG. 1 shows a front view of a preferred embodiment of a present invention device.
Figure 2:
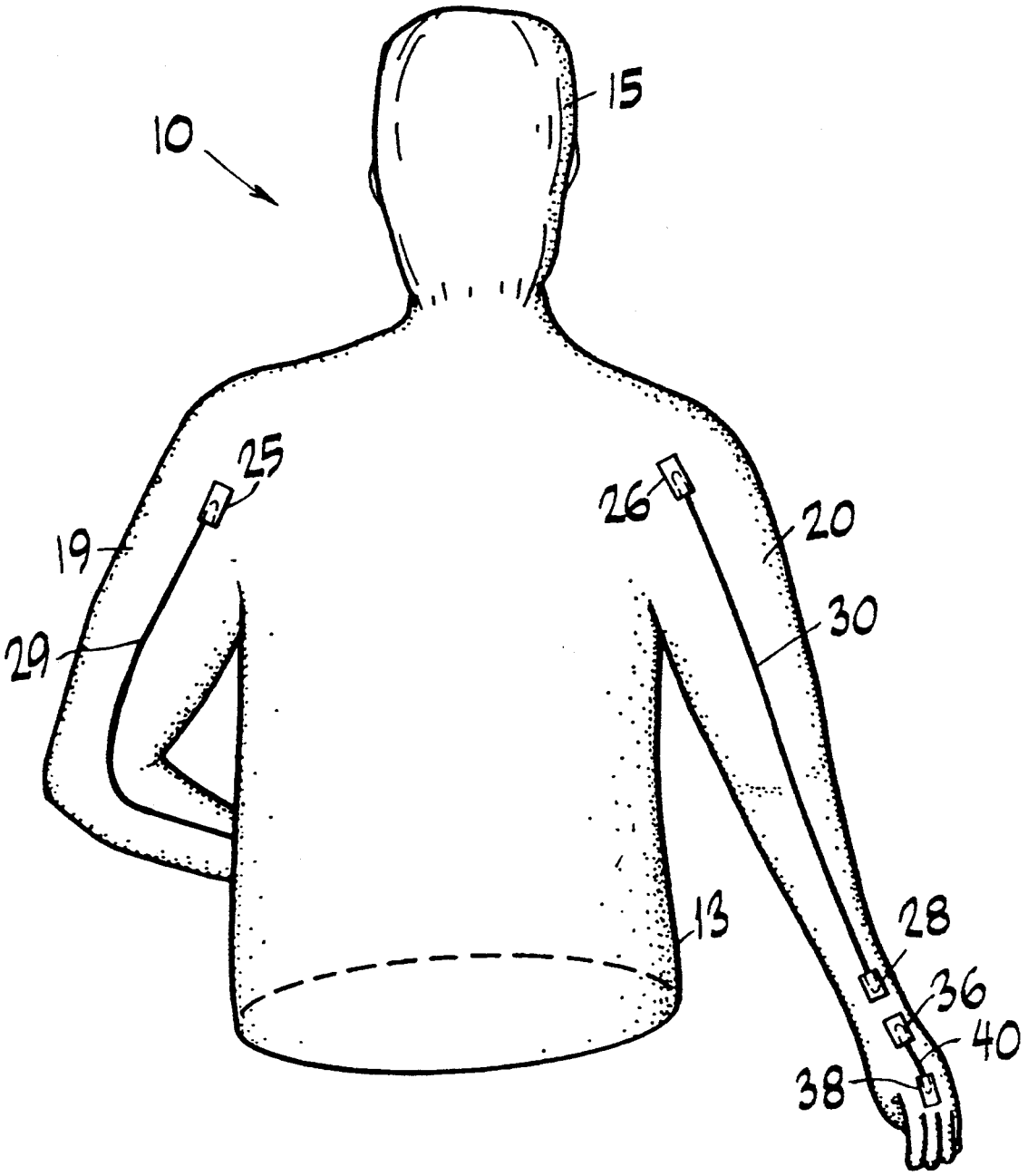
FIG. 2 shows a rear view of the embodiment of FIG. 1.

FIGS. 1 and 2 show front and rear views, respectively, of a preferred embodiment of the present invention inflatable body 10. Plastic exoskeleton 13 is shown inflated forming a head 15, torso 17, left arm appendage 19 and right arm appendage 20 with left hand 21 and right hand 22. The hands are optional. The invention may also be made without hands, if desired. Valve, 23, allows inflation and deflation of inflatable body 10. In this embodiment, FIG. 2 shows left upper inserting means 25 (left lower inserting means is not visible), right upper inserting means 26 and right lower inserting means 28 located on the outside rear of plastic exoskeleton 13 at the upper and lower regions of left arm appendage 19 and right arm appendage 20. Left elongated insert 29 and right elongated insert 30 are inserted into left upper inserting means 25 and right upper inserting means 26 and left lower inserting means (not shown) and right lower inserting means 28 as shown in FIG. 2. The inserting means may be plastic sleeves heat sealed on three sides to the outside of plastic exoskeleton 13 in the upper and lower regions of the left arm appendage 19 and right arm appendage 20 although any number of inserting means are possible. Left and right elongated inserts 29 and 30 may be, for example, flexible wire with sufficient elasticity and rigidity to allow a user to mold left arm appendage 19 and/or right arm appendage 20 into a desired changeable position and hold that position. In the embodiment of FIGS. 1 and 2, left arm appendage 19 is shown bent at the elbow by virtue of the user bending left elongated insert 29. Left arm 19 is held in this position by bent elongated insert 29. (If desired, elongated insert 29 may be run through an additional open ended tunnel-like sleeve located in the elbow area of the arm for additional control of appendage maneuverability). Further, in this embodiment, left hand 21 is held in a grasping position by additional elongated wire inserts typified by left wire insert 33 inserted into additional inserting means typified by left sleeve insert 35. Right hand 22 is shown in an open position in this embodiment but could be placed in a grasping position by bending an additional elongated insert typified by right wire insert 40 inserted into additional right sleeves typified by right sleeve inserts 36 and 38 located on the back of right hand 22 as shown in FIG. 2. It can readily be seen that various positions are possible by moving the various elongated inserts as desired. The elongated inserts may be permanently fixed in the inserting means or, more preferably in this embodiment, they may be removable from the inserts for more compact storage of the multi-position inflatable auto decoy when not in use.

The elongated inserts may also be made of material other than flexible wire, i.e. plastic or wooden dowels or rods. In such cases, various fastening means attached in appropriate places on the outside of the plastic exoskeleton torso and appendage regions would allow a user to position the inflatable decoy in various poses.

Figure 3:
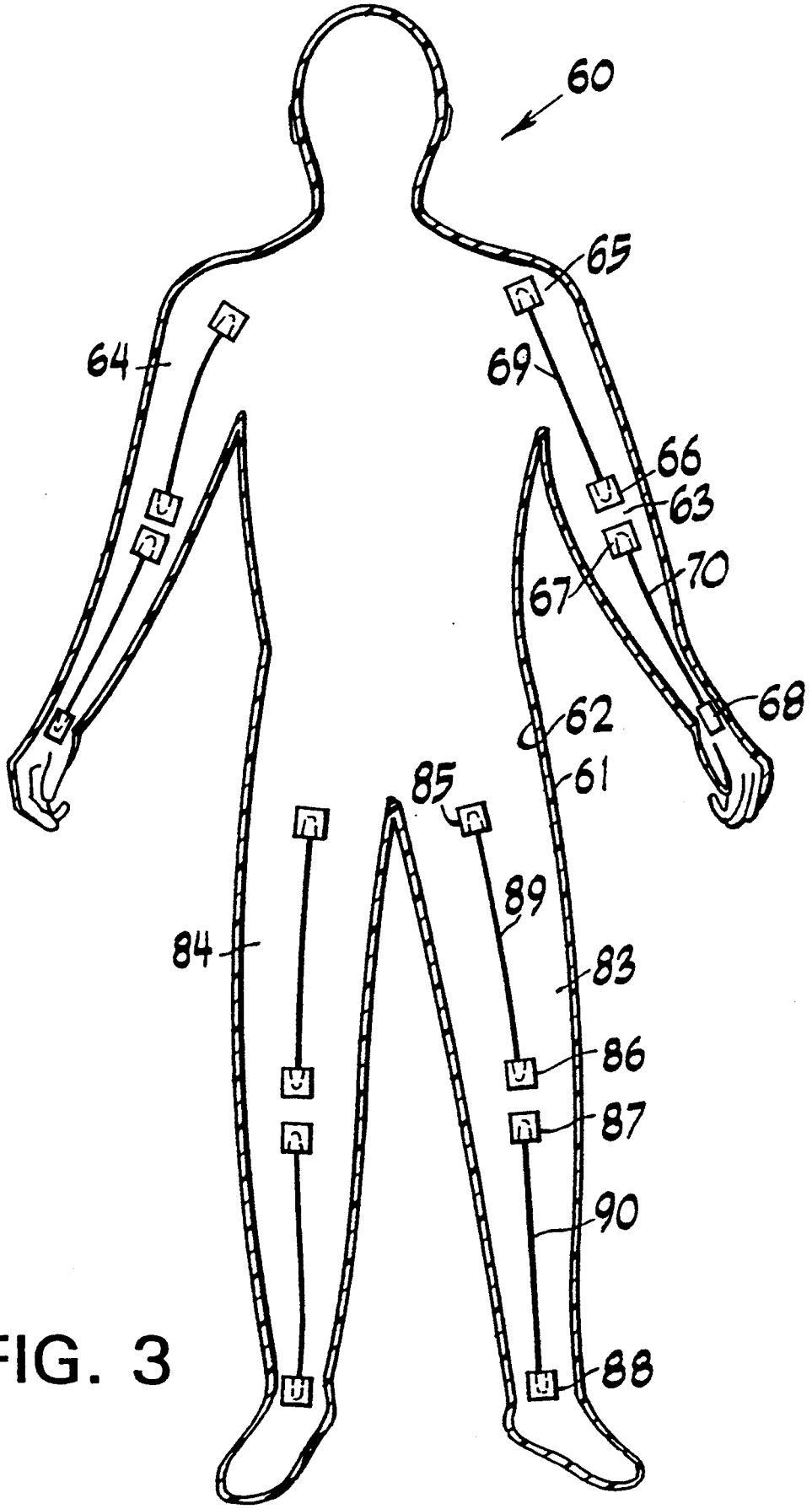
FIG. 3 shows a cut view of an alternative embodiment of the present invention device; and, FIG. 4 shows a front view of the alternative embodiment of FIG. 3.

FIG. 3 shows a cut view of an alternative embodiment of the present invention wherein the inserting means are manufactured such that they are located on the inside 62 of the plastic exoskeleton 61. Alternative inflatable body 60 shows plastic exoskeleton 61 and appendages 63, 64, 83 and 84. Upper arm inserting means 65 and 66 and lower arm inserting means 67 and 68 as well as upper leg inserting means 85 and 86 and lower leg inserting means 87 and 88 are affixed to the inside 62 of plastic exoskeleton 61. Elongated inserts 69, 70, 89 and 90 are inserted into the inserting means and remain inserted thus on the inside of the multi-positional inflatable auto decoy whether inflated or deflated. In this embodiment elongated inserts 69, 70, 89 and 90 may be rigid rods or dowels made of plastic, wood or any other suitable material. They may also be made of flexible wire if desired. If flexible wire is used, it may not be necessary to have a full set of inserting means in both the upper and lower potions of the arm. In the case of flexible wire inserts, one inserting means at the upper portions of the arms and legs one at the lower portions of the arms and legs would suffice since the appendages 63, 64, 83 and 84 would be moldable (i.e. bendable at the elbow and/or knee) by virtue of the flexibility of the wire. (If desired, such a flexible wire insert may be run through an open ended tunnel-like sleeve located at the knee and/or elbow areas of the appendages for addition control of maneuverability.)

Figure 4:
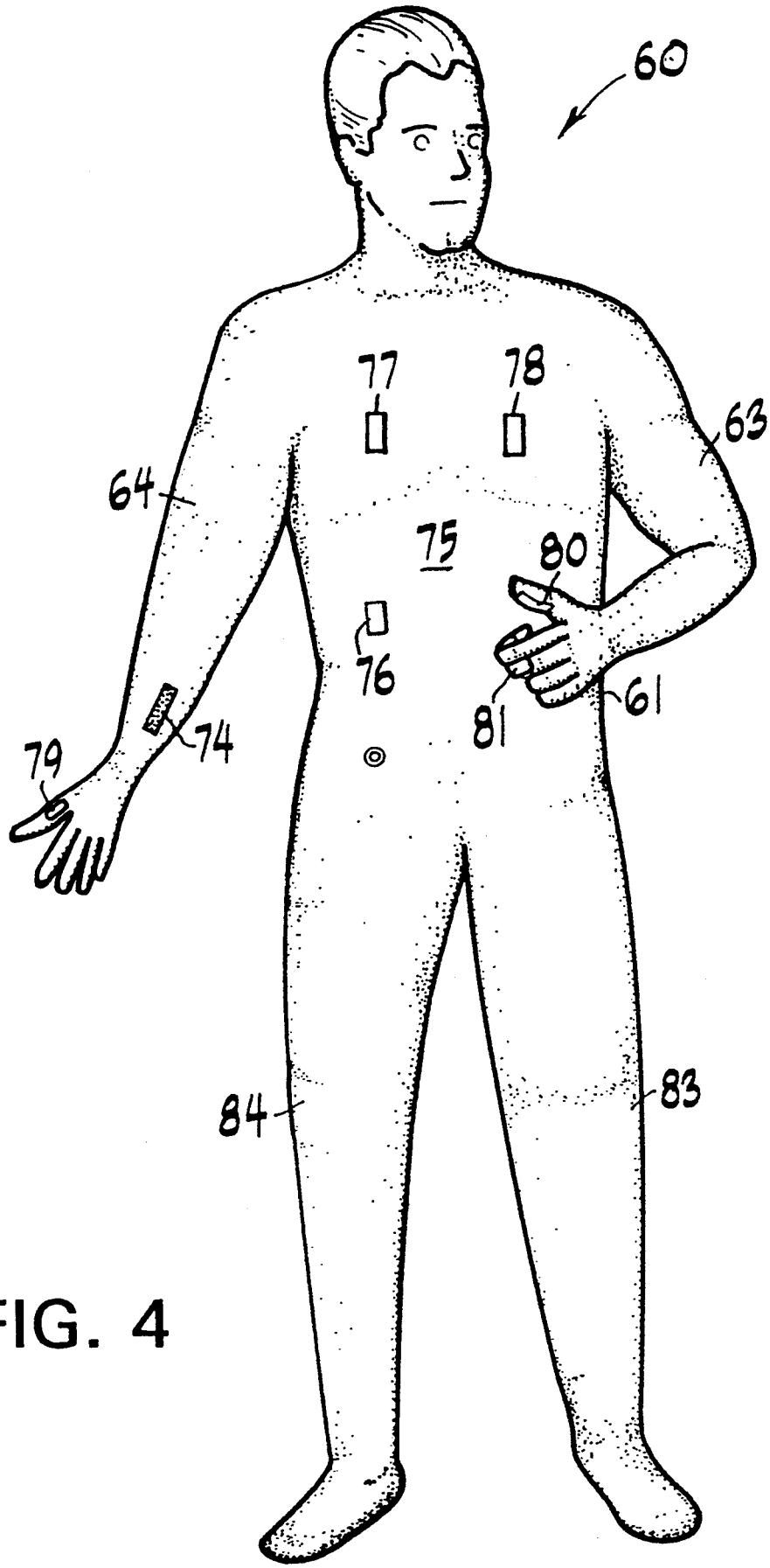

FIG. 4 shows an outside front view of the embodiment of FIG. 3 wherein like parts are like numbered and left arm appendage 63 is bent. Inflatable decoy 60 is equipped with fasteners 76, 77, and 78 on the outside of plastic exoskeleton 61 in the region of the torso 75 and fasteners typified by fastener 74 in the lower arm appendage region. Thus, left arm appendage 63 and/or right arm appendage 64 may be placed in various positions and held by fasteners typified by fasteners 74, 76, 77 and 78. FIG. 4 shows left arm appendage 63 bent and held in position by a fastener (not shown) located at the bottom of left arm appendage 63 and a fastener located on the outside of plastic exoskeleton 61 in the lower left torso region (not shown). The equivalent fasteners may be seen on the right side of inflatable body 60 in FIG. 4 wherein fastener 74 is located in the lower region of right arm appendage 64 on the outside of plastic exoskeleton 61 and fastener 76 is located in the lower right region of torso 75 on the outside of plastic exoskeleton 61. Although any fastening means may be used, a hook and loop fastener such as VELCRO® (VELCRO Corp., New York, N.Y.) is preferred. Additionally, FIG. 4 shows thumb fasteners 79 and 80, and hand fastener 81, preferably VELCRO®, which serve to hold the hands in a grasping position if desired, for instance, by bringing thumb fastener 80, in contact with hand fastener 81. Thus, a hand may be placed in a grasping position with such fasteners and be capable of holding an object such as a coffee cup, imparting a more life-like appearance.

Obviously numerous modifications and variations of the present invention are possible in light of the above teachings. It is therefore understood that within the scope of the appended claims, the invention may be practiced otherwise than as specifically described herein.

What is claimed is:

1. An inflatable multi-positional auto decoy representative of the upper portion of a human form adapted to be buckled into place by a car seat belt comprising:

a) a plastic inflatable exoskeleton with an inner side and an outer side molded to represent a torso, a head and two arms;

b) upper inserting means and lower inserting means located on said plastic exoskeleton in the region of at least one of said arms for receiving an upper end and a lower end of elongated inserts recited below; and, c) elongated inserts each having an upper end and a lower end, said upper end inserted into said upper inserting means and said lower end inserted into said lower inserting means of at least one of said arms.

2. The inflatable body of claim 1 wherein said inserting means are located on the outer side of said exoskeleton.

3. The inflatable body claim 1 wherein said inserting means are located on the inner side of said exoskeleton.

4. The inflatable body of claim 1 further including:

d) fasteners attached to the outside of said exoskeleton in the region of said torso and in the region of at least one of said arms to hold at least one of said arms in a desired position.

5. The inflatable body of claim 4 wherein said fasteners are hook and loop fasteners.

6. The inflatable body of claim 1 wherein said elongated inserts are flexible wire inserts with a sufficient amount of rigidity and elasticity such that at least one of said arms may be moved into a desired changeable position and held in said desired changeable position.

7. The inflatable body of claim 1 wherein at least one of said arms includes a hand with fasteners located on said hand such that said hand may grasp and hold a separate object.

8. The inflatable body of claim 7 wherein said fasteners are hook and loop fasteners.

9. The inflatable body of claim 6 wherein at least one of said arms includes a hand with fasteners located on said hand such that said hand may grasp and hold a separate object.

10. The inflatable body of claim 9 wherein said fasteners are hook and loop fasteners.

11. The inflatable body of claim 1 wherein at least one of said arms includes a hand with additional inserting means.

12. The inflatable body of claim 11 wherein elongated flexible wire inserts are inserted into said additional inserting means.

13. The inflatable body of claim 12 wherein said elongated inserts are of sufficient rigidity and elasticity to move said hand into a desired changeable position and hold said hand in said desired changeable position.

14. The inflatable body of claim 4 wherein said elongated inserts are rigid dowels.

15. The inflatable body of claim 5 wherein said elongated inserts are rigid dowels.

16. The inflatable body of claim 4 wherein at least one of said arms includes a hand with fasteners located on said hand such that said hand may grasp and hold a separate object.

17. The inflatable body of claim 16 wherein said fasteners are hook and loop fasteners.

18. The inflatable body of claim 16 wherein said elongated inserts are rigid dowels.

19. The inflatable body of claim 17 wherein said elongated inserts are rigid dowels.

* * * * *